US005651666A

United States Patent [19]

Martin

[11] Patent Number: 5,651,666

[45] Date of Patent: Jul. 29, 1997

[54] DEEP-WELL FLUID-EXTRACTION PUMP

[76] Inventor: John Kaal Martin, 2514 Old Fort Rd., Sugarland, Tex. 77479

[21] Appl. No.: 576,159

[22] Filed: Dec. 21, 1995

[51] Int. Cl.[6] ..... F04B 9/14; F04B 17/00

[52] U.S. Cl. ..... 417/375; 417/403; 417/528; 417/555.2; 60/377; 91/318; 91/337; 277/58; 277/165

[58] Field of Search ..... 417/375, 390, 417/403, 404, 528, 534, 555.2; 60/376, 377; 91/219, 318, 337; 277/53, 58, 101, 165

[56] References Cited

U.S. PATENT DOCUMENTS

| | | | |
|---|---|---|---|
| 2,923,973 | 2/1960 | Ninneman | 60/377 |
| 3,212,444 | 10/1965 | Wells | 417/528 |
| 3,272,520 | 9/1966 | Woolfenden | 277/165 |
| 4,214,854 | 7/1980 | Roeder | 417/402 |
| 4,234,294 | 11/1980 | Jensen | 417/403 |
| 4,295,801 | 10/1981 | Bennett | 417/397 |
| 4,383,803 | 5/1983 | Reese | 417/259 |
| 4,544,335 | 10/1985 | Roeder | 417/401 |
| 4,925,374 | 5/1990 | Darrens | 417/403 |
| 5,104,296 | 4/1992 | Roeder | 417/403 |
| 5,494,102 | 2/1996 | Schulte | 417/403 |

*Primary Examiner*—Charles G. Freay
*Attorney, Agent, or Firm*—Maryam Bani-Jamali

[57] ABSTRACT

This invention features a small-enveloped (with an outside diameter of at least approximately 38 mm), single-acting, hydraulically-operated, reciprocating, deep-well, fluid-extraction pump, operable in non-straight and angular wells, and its mode of operation. The hydraulically-operated, deep-well pump, in addition to having an above-ground installation of its motor-fluid generator and of its control valving, comprises a compound, stepped piston that is reciprocably mounted within a cylinder which in turn is divided into individual pressure chambers. Hydrostatic pressure created by a hydraulic pump is selectively directed to two outlet ports to produce an overpressure in one of the outlet ports at any given instant. The overpressure in each outlet port leads to creation of overpressure in one or more pressure chambers. Imbalances in pressure among the pressure chambers result in movement of the compound, stepped piston and extraction of hydraulic-well fluid by the compound, stepped piston. Reversals in flow pattern of the pressurized hydraulic-well fluid are realized by changing alignments of the outlet ports from parallel-flow porting to crossed-flow porting and vice versa. Individually adjustable pumping-cycle and suction-cycle time and independently adjustable up- and down-stroke velocity, as well as independently adjustable time delay for well recovery, may be allowed. An improved self-cleaning suction filter is used in screening any hydraulic-well fluid and an anti-gaslocking design is presented. Function of dynamic, preferably metallic, self-adjusting, fluid seals, used in the hydraulically-operated, deep-well pump is based upon a dynamic, pressure drop of turbulent axial flow through a plurality of closely-controlled, radial clearances and a plurality of closely-fitting seal rings.

10 Claims, 2 Drawing Sheets

DEEP-WELL FLUID-EXTRACTION PUMP

BACKGROUND OF THE INVENTION

1. Field of the Invention

This invention relates to a small-enveloped, single-acting, hydraulically-operated, reciprocating, deep-well, fluid-extraction pump and its mode of operation. More particularly, this invention relates to a small-enveloped, single-acting, hydraulically-operated, reciprocating, deep-well, fluid-extraction pump having an above-ground installation of its motor-fluid generator and of its control valving, with the hydraulically-operated, deep-well pump comprising a compound, stepped piston that is reciprocably mounted within a cylinder which in turn is divided into individual pressure chambers, and to the mode of operation of said hydraulically-operated, deep-well pump.

2. General Background

In designing fluid-extraction pumps for deep wells, some factors should always be taken into consideration. The fluid-extraction pump should be simple in design and should include a minimum number of parts to be capable of being fit into small well bores. In addition, the pump should have a relatively short physical length to be passed through curved sections of well casing and into angular wells relatively easily. Different components of the fluid-extraction pump should be designed under one common goal: provision of a very long service life for the pump. A pump with these desirable attributes would most probably withstand early malfunction and breakage of various component parts thereof. It is also desirable that the pump would use energy as efficiently as possible and that power requirement for fluid extraction are considerably less than could be expected for proportionally deeper wells.

3. Description of the Prior Art

In the prior art, different types of pumps have been used in an attempt to solve the problems faced in deep-well, fluid extraction. Some devices have been repeatedly used. Reciprocating, deep-well pumps, used for the extraction of petroleum fluids, brine or water, have been designed to fit into large bore wells and are normally connected to surface machinery through an elongate operating puller, commonly known as "sucker rod". The so-called "sucker rod" pumps are single-acting pumps that have proven to be beneficial for pumping straight and truly vertical wells. However, "sucker rod" pumps are limited to straight wells and cannot be operated in bowed wells, slanted wells, horizontal wells, and/or angular wells.

Meanwhile, high-force, low-speed, mechanical equipment, including but not limited to pumping jacks, have been used to reciprocate pumping mechanisms. These high-force, low-speed, mechanical equipment are costly and necessitate a considerable upkeep. A high maintenance cost and considerable upkeep of these mechanical equipment are only justifiable in high-output wells since the output of mechanically-operated pumps is limited to at most one-sixth of natural frequency of an elastic interaction of the sucker rod and bulk modulus of any pumped fluid.

Hydraulically-operated, single-acting, positive-displacement pumps are a different type of pump wherein a power or pumping stroke and a return or recharge stroke is accomplished by a combination of hydraulic pressure and spring pressure or by a combination of hydraulic pressure and compressed gas pressure. Most hydraulically-operated pumps utilize a considerable volume of effective operating fluid and are limited to number of pumping cycles per minute due to cyclic operations of pressurization and recovery, the expansion and contraction of the pressure line, the fluid friction during downhole and return-flow cycles, and fluid viscosity.

Energy transfer of fluid power is utilized to reciprocate hydraulically-operated, single-acting or double-acting pumps. Hydraulic power that is generated by an above-the-ground, central, power station is conducted to the pumping unit through at least one tube, with each tube acting alternatively as a conductor of pressurized fluid. The fluid flow of any motor fluid is selectively switched by valving that is interconstructed into each power piston. Fluid passages and valves for any motor fluid, as well as for any pumped fluid, dictate certain minimum sizes. The minimum sizes, in turn, define a minimum envelope for a down-hole pump. Establishment of minimal sizes may not be applicable to small-bore wells and may only have to be limited to large-bore wells. The miniaturization of the valving, as well as constant existence of contaminants (including but not limited to sand) in the pumped fluid, have made previous, hydraulically-operated, single-acting or double-acting pumps unreliable.

In addition, a large number of patents have been issued which have attempted to solve one or more of the above issues or some other similar problems related to deep-well, fluid extraction. A summary of some of the more relevant of said patents follow.

Roeder, U.S. Pat. No. 4,214,854, registered on Jul. 29, 1980, (referred to as '854) and U.S. Pat. No. 5,104,296, registered on Apr. 14, 1992, (referred to as '296), for example, discuss hydraulically-actuated pump assemblies. In '854, Roeder patents a mechanically-actuated valve assembly contained within a piston of an engine of a downhole hydraulically-actuated pump assembly, the engine being reciprocatingly connected to a production pump, and arranged with respect to various different flow passageways such that flow of power fluid downhole to and through the engine, while production fluid and spent power fluid are conducted uphole to the surface of the ground, forces the engine piston to reciprocate. The valve assembly includes a control rod and a valve element concentrically arranged with respect to one another and to the engine piston. Reciprocation of the control rod causes the valve element to reciprocate respective to the engine piston. In '296, Roeder patents a pump end of a hydraulically actuated downhole pump assembly, powered by a fluid that is pumped downhole to an engine end thereof. The pump end is connected to a source of formation fluid so that the engine end drives the pump end which in turn lifts produced fluid to the surface of the ground. The pump end has a pump barrel within which a pump piston is reciprocatingly received in sealed relationship. The engine end has an outer engine barrel within which an annular valve element is reciprocatingly received in sealed relationship. The valve element moves up and down between two positions of operation while an engine piston reciprocates within the annular valve element and, thus, aligns various flow passageways in a manner to alternately apply power fluid to appropriate sides of the piston and valve element to force the engine piston to reciprocate.

Roeder, U.S. Pat. No. 4,544,335, issued on Oct. 1, 1985, patents a downhole hydraulically actuated pump assembly, comprising: a power piston actuating a production plunger.; a valve means concentrically arranged within the power piston; and a stationary, hollow, valve-control rod extending through the power piston and through the valve means and having a lower marginal end which terminates within the production plunger. Power fluid flows through the valve-control rod and to the valve means. Means on the valve-control rod actuates the valve means between two alternant positions so that power fluid is applied to bottom face of the power piston, causing the power piston to reciprocate upward; and thereafter, the valve-control rod causes the valve means to shift to the other position, whereupon spent power fluid is exhausted.

Canens, U.S. Pat. No. 4,925,374, issued on May 15, 1990, discusses a sub-surface hydraulically operated engine for reciprocating an oilwell pumping unit. The engine includes confined hydraulic fluid means for actuating a reversing valve and its lifter in order to change the upstroke motion to downstroke motion and vice versa.

Reese, U.S. Pat. No. 4,383,803, was issued on May 17, 1983. Reese patents a device for lifting liquid from boreholes, said device comprising: a pump being located downhole near production formation and consisting of a fluid-actuated, double-action piston. The pump is connected by fluid pressure lines to a source of fluid pressure disposed above ground and a switching valve is connected to provide fluid pressure to alternate sides of the piston to effect reciprocation thereof.

Bennett, U.S. Pat. No. 4,295,801, was issued on Oct. 20, 1981. Bennett patents a small-diameter, fluid-powered, submersible, sampling pump including an elongated, cylindrical body formed by: a pair of hollow chambers of a motor piston; and a centrally-disposed, control-valve, block assembly being located on opposite sides of the motor piston chambers and joined thereto and containing, in axial alignment with the motor piston, a spool pilot valve and a spool fluid-distribution valve. The spool pilot valve, which is constructed to obviate stalling during its reciprocation under the impress of a power fluid directed thereto and functions to control the shifting of the distribution valve to which it is internally connected within the valve block assembly, comprises: a valve housing defining a large, central, piston chamber; a relatively small bore extending axially inwardly from one end of the valve housing and into communication with the large, central, piston chamber; and a larger bore of smaller diameter than the central, piston chamber extending axially into the opposite end of the valve housing into communication with the central, piston chamber. A small piston is slidably positioned in the relatively small bore, a larger piston in the larger bore and a largest piston in the central piston chamber. A power fluid charging port communicates with the central piston chamber through the valve housing, such that sealing means on the largest piston in the central piston chamber allows power fluid to bleed from the power fluid charging port to opposite sides of the largest piston when the sealing means is directly aligned with the power fluid charging port.

Hydraulically-operated, deep-well, fluid-extraction pumps discussed above and existing in prior art have several major disadvantages in common which are intended to be avoided in the present invention. The hydraulically operated deep well pumps of previous art have the directional fluid flow control valve, installed within the mechanism of pump piston, in order to reduce the time required for the travel of pressure shock wave, in the power line(s) (e.g. 1530 m/sec), at the cost of high failure rate of the built-in, directional-flow, control valve, in sand laden ambient.

Therefore, it is desirable to develop a hydraulically-operated, deep-well, fluid-extraction pump that would overcome the above defects while performing any required task.

SUMMARY OF THE INVENTION

A primary object of the present invention is to provide a dependable means for extracting fluids from deep wells and from low-production wells.

Another object of the present invention is to provide a hydraulically-operated, deep-well, fluid-extraction pump controlled by a hydraulic-power, control system and having an above-ground installation of its motor-fluid generator and of its control valving.

Still another object of the present invention is to design a hydraulically-operated, deep-well, fluid-extraction pump that is simple in construction, ragged and reliable in operation, and relatively inexpensive to manufacture.

Another object of the invention is to design a relatively-short, fluid-extraction pump which can fit into very small well bores and, due to its relatively-short, physical length, can be passed through curved sections of well casings and into vertical, bowed, angular and horizontal wells.

An additional object of the present invention is to provide hydraulically-operated, fluid-extraction pumps such that depths of fluid columns have minimal bearing on power requirement for fluid extraction.

Another object of this invention is to design self-cleaning, dynamic, suction filters for fluid-extraction pumps in order to reduce ingestion of sand in the well fluid.

A further object of this invention is to design ridged, dynamic, self-adjusting, fluid seals that would maximize service life for fluid-extraction pumps.

Another object of the present invention is to provide a hydraulic-operated, deep-well, fluid-extraction pump having a minimum number of moving parts.

An additional object of the present invention is to design constant-force, gravity-operated, fluid-flow, check valves for hydraulically-operated, deep-well, fluid-extraction pumps.

A further object of this invention is to design a fluid-extraction pump that eliminates the formation of gas and vapor locks during pumping operation.

Another object of this invention is to design an above-ground, hydraulic, power-generating station for operating a plurality of deep wells which are located in reasonable proximity to one another.

A further object of this invention is to introduce a fluid-extraction pump with adjustable, equal or unequal time allowed for suction cycles and for discharge cycles.

Another object of the present invention is to provide a hydraulically-operated, deep-well, fluid-extraction pump having a hydraulic-power, control system which is responsive to production output of the well.

An additional object of the present invention is to provide a fluid-extraction pump which, based upon an absence of production fluid flow, would trigger an adjustable, well-recovery, time delay before commencement of a following pumping period.

A final object of the invention is to design a fluid-extraction pump that, upon usage of completely metallic seals, can operate with very hot fluids.

Additional objects and advantages of the invention will be set forth in part in a detailed description which follows, and in part will be obvious from the description, or may be learned by practice of the invention.

The present invention defines a pumping system that is intended for small-enveloped (preferably approximately 38 mmϕ), single-acting, hydraulically-operated, reciprocating, deep-well, fluid-extraction pumps 60 (referred to as "hydraulically-operated, deep-well pumps") having an above-ground installation of its motor-fluid generator and of its control valving. The hydraulically-operated, deep-well pump 60 presented in this pumping system provides a production chamber M, a series of pressure chambers comprising a top, pressure chamber R, a middle, pressure chamber S, and a bottom, pressure chamber I (or pumping chamber I), in descending order from ground level downwards, and a compound, stepped piston 19 comprising a telescopic, fluid line 11, a tubular, middle section 62 and a suction robe 46. The telescopic, fluid line 11 has a projected, annular area C, and the tubular, middle section 62 has a top, annular, piston area D, a middle, annular, piston area E, and a bottom, annular, piston area F, in descending order. Except for the existence of a connection through a number of free passages 9 between the production chamber M and the top, pressure chamber R, connections among the series of pressure chambers are established by the compound, stepped piston 19. The production chamber M holds an upper, central conduit N, leading to the above-ground installation, and a lower, central conduit Q, through which the telescopic, fluid line 11 of the compound, stepped piston 19 slides up and down, from the top, pressure chamber R to the lower, central conduit Q and vice versa. The telescopic, fluid line 11 connects the lower, central conduit Q to the middle, pressure chamber S. A fluid passage 22 passing through a production fluid-discharge, pump-valve means, comprising an upper, check valve 27, connects the top, pressure chamber R to the bottom, pressure chamber I. The suction robe 46, connects a dynamic, suction filter 47, positioned below the bottom, pressure chamber I, to the bottom, pressure chamber I through a production fluid-inlet, pump-valve means, comprising a suction, check valve 36. Existing hydraulic-well fluid is divided into a top section (i.e. top, hydraulic-well fluid V) and a bottom section (i.e. bottom, hydraulic-well fluid U). Up-and-down motion of the dynamic, suction filter 47 sets the top, hydraulic-well fluid V and the bottom, hydraulic-well fluid U in high velocity motion, past the dynamic, suction filter 47, and dislodges the sand particles, settled on the outer surface of the dynamic, suction filter 47.

Hydrostatic pressure of a hydraulic pump 119 energizes consecutively and alternately two outlet ports: a production-chamber, outlet port A and a central-conduit, outlet port B of a four-port, fluid-flow, directional, control valve 108 (referred to hereinafter as "four-port, control valve 108"). Normally, fluid lines of the production-chamber, outlet port A and of the central-conduit, outlet port B of the hydraulically-operated, deep-well pump 60 are filled with a fluid up to the four-port, control valve 108. Both fluid lines, being of equal height, produce equal hydrostatic pressure at the hydraulically-operated, deep-well pump 60. The overpressure produced by the hydraulic pump 119 is selectively directed, through a pressure port P, to the production-chamber, outlet port A and to the central-conduit, outlet port B through the four-port, control valve 108 and is used to operate the hydraulically-operated, deep-well pump 60. At any given instant, when one of the outlet ports of the four-port, control valve 108 is overpressurized with respect to the other outlet port, the other outlet port is vented through a deposit port T, using a flow-restriction valve 103 and a flow-sensor switch 102, to a deposit 100 (e.g. a deposit tank). A pair of circuit operators act as cycle-timing control and energizing pilots and are used for changing hydraulic, fluid-flow patterns, with a right-pilot, circuit operator $S_1$ being used for changing hydraulic, fluid-flow pattern from parallel-flow porting to crossed-flow porting and with a left-pilot, circuit operator $S_2$ being used for changing hydraulic, fluid-flow pattern from crossed-flow porting to parallel-flow porting. The hydrostatic overpressure conducted from the pressure port P, through the central-conduit, outlet port B of the four-port, control valve 108, with the left-pilot, circuit operator $S_2$ energized, acts upon the projected, annular area C of the telescopic, fluid line 11, and through said telescopic, fluid line 11, upon the middle, annular, piston area E of the compound, stepped piston 19. This overpressure upon the middle, annular, piston area E elevates the compound, stepped piston 19 to its uppermost position.

Force exerted under the middle, annular, piston area E of the compound, stepped piston 19 creates an upward force on the middle, annular, piston area E and raises the compound, stepped piston 19, starting an upstroke. An upward flow of fluid from the top, pressure chamber R through the number of free passages 9, due to the upward movement of the compound, stepped piston 19, results in an increase in a previously-existing, around-atmospheric pressure of the bottom, pressure chamber I. The increased pressure in the bottom, pressure chamber I leads to discharge of fluid from the production-chamber, outlet port A through the deposit port T into the deposit 100, as well as, during boosted pressures, reverse injection of the fluid from the top, pressure chamber R through a check valve 121 and a relief valve 122, connected through the check valve 121 to the production-chamber, outlet port A, and through a flow-restriction valve 103 and a flow-sensor switch 102 into the deposit 100.

Raising of the compound, stepped piston 19 is accompanied by the elevation of the dynamic, suction filter 47. During each upstroke, due to atmospheric pressure upon the hydraulic-well fluid, combined with the static column of the hydraulic-well fluid, the hydraulic-well fluid is pushed upward through the dynamic, suction filter 47 to fill the space developed in the evacuated bottom, pressure chamber I while the dynamic, suction filter 47 with a fine-mesh screen, sealed between a top and bottom cover 49, is elevating. The upward motion of the dynamic, suction falter 47 displaces the top, hydraulic-well fluid V downward through a narrow clearance between the screen of the dynamic, suction filter 47 and a bottom, tubular, outer sleeve 45, dislodging sand particles that have settled on the screen of the dynamic suction filter 47 from a previous suction cycle. The raise of the dynamic, suction filter 47 results in filling of the bottom, pressure chamber I with filtered hydraulic-well fluid captured from the high-velocity fluid stream, passing by from the top, hydraulic-well fluid V to the bottom, hydraulic-well fluid U. The recovered filtered hydraulic-well fluid is collected through a plurality of radial holes of the suction tube 46, conducted through the suction, check valve 36, and discharged through radial holes 37 in the tubular, middle section 62 and through radial clearance K of a lower, cylindrical piston 38 (i.e. an injection piston 38) into the bottom, pressure chamber I. The bottom, pressure chamber I increases in size and allows the hydraulic-well fluid to introduce through radial clearance K of the lower, cylindrical piston 38 into the bottom, pressure chamber I, impulsed by the atmospheric pressure upon the hydraulic-well fluid and a static head of the hydraulic-well fluid.

After an appropriate time delay (i.e. a fraction of a second to a few seconds), the left-pilot, circuit operator $S_2$ of the four-port, control valve 108 reverses the flow pattern of pressurized hydraulic fluid, where the pressure port P is aligned with the production-chamber, outlet port A, and return flow from the central-conduit, outlet port B is conducted through the deposit port T into the deposit 100, using the flow-restriction valve 103, with overflow being directed to the flow-sensor switch 102. The hydraulic overpressure from the production-chamber, outlet port A is conducted through the production chamber M and the number of free passages 9 to the top, pressure chamber R, and acting upon the top, annular, piston area D, lowers the compound, stepped piston 19.

An axial force is developed on the compound, stepped piston 19 and transmitted from the top, annular, piston area D to the bottom, annular, piston area F. It is this transmittal of axial force exerted downwards that keeps the upper, check valve 27 closed originally. The axial force exerted upon the top, annular, piston area D by the pressure of the reversed pressurized fluid flow from the production-chamber, outlet port A results in an increased hydraulic pressure on the bottom, pressure chamber I due to a lower, active, piston area offered by the bottom, annular, piston area F, causing an intensification, or a pressure boost, in the bottom, pressure chamber I. Simultaneously, downward transmittal of axial force through the compound, stepped piston 19 results in an increased hydraulic pressure on the middle, pressure chamber S by the middle, annular, piston area E, leading to limited discharge of the middle, pressure chamber S via the telescopic, fluid line 11 and, then, via the central-conduit, outlet port B to the deposit port T. Consecutively, the right-pilot, circuit operator $S_1$ is energized again and the flow pattern of pressurized, hydraulic fluid reverses to crossed-flow porting and the pressure port P is aligned with the central-conduit, outlet port B once again while the production-chamber, outlet port A is aligned with the deposit port T.

A time allowed for a pumping cycle and a time allowed for a suction cycle (each also referred to as "a stroke") result, with duration of each cycle being individually adjustable. A reciprocating pumping action develops that pumps production fluid flow and that is controlled by a production fluid flow sensing device. In the absence of any production fluid flow, the pumping cycle and the suction cycle of the hydraulically-operated, deep-well pump 60 are stopped by a timer 104, leading to a well-recovery cycle. Upon passage of a predefined time period, the timer 104 restarts a drive motor 118 of the hydraulic pump 119. The hydraulically-operated, deep-well pump 60 will be performing as long as the production fluid flow sensing device continues to be operated by the flow of production fluid. As a result, dependency of the reciprocating pumping action on the presence or absence of production fluid for the hydraulically-operated, deep-well pump 60 can lead to saving of the hydraulically-operated, deep-well pump 60 by the reciprocating pumping action from "dry" wear, thus allowing the operator to select an optimum well-recovery cycle. Power requirements are minimal and are solely used to overcome friction of dynamic fluid seals in the hydraulically-operated, deep-well pump 60, elevation of production fluid from ground level to over-head deposit, and fluid friction of both fluid conducting lines, to whole length of pipe string. It is worthy to note that pumping depth has minimal bearing upon the power requirements, except on fluid friction of fluid conducting lines.

It is to be understood that the descriptions of this invention are exemplary and explanatory, but are not restrictive, of the invention. Other objects and advantages of this invention will become apparent from the following specification and from any accompanying charts, tables and examples.

BRIEF DESCRIPTION OF CHARTS, TABLES AND EXAMPLES

Any accompanying charts, tables and examples which are incorporated in and constitute a part of this specification, illustrate examples of preferred embodiments of the invention and, along with the description, serve to explain the principles of the invention.

FIG. 1(*a*), FIG. 1(*b*) and FIG. 1(*c*) taken together are a longitudinal cross-sectional view of the single-acting, hydraulically-operated, reciprocating, deep-well, fluid-extraction pump in accordance with the present invention, with FIG. 1(*a*), FIG. 1(*b*) and FIG. 1(*c*) illustrating an upper section, an intermediate section and a lower section, respectively, of the deep-well, fluid-extraction pump.

FIG. 2(*b*) is a schematic drawing showing operation of the hydraulically-operated, deep-well, fluid-extraction pump which is demonstrated in FIG. 1(*a*), FIG. 1(*b*) and FIG. 1(*c*).

DETAILED DESCRIPTION OF THE PREFERRED EMBODIMENT

Preferred embodiments of the present invention are illustrated in any charts, tables and examples that follow.

STRUCTURE OF THE HYDRAULICALLY-OPERATED, DEEP-WELL PUMP

Figures 1A, 1B, 1C:
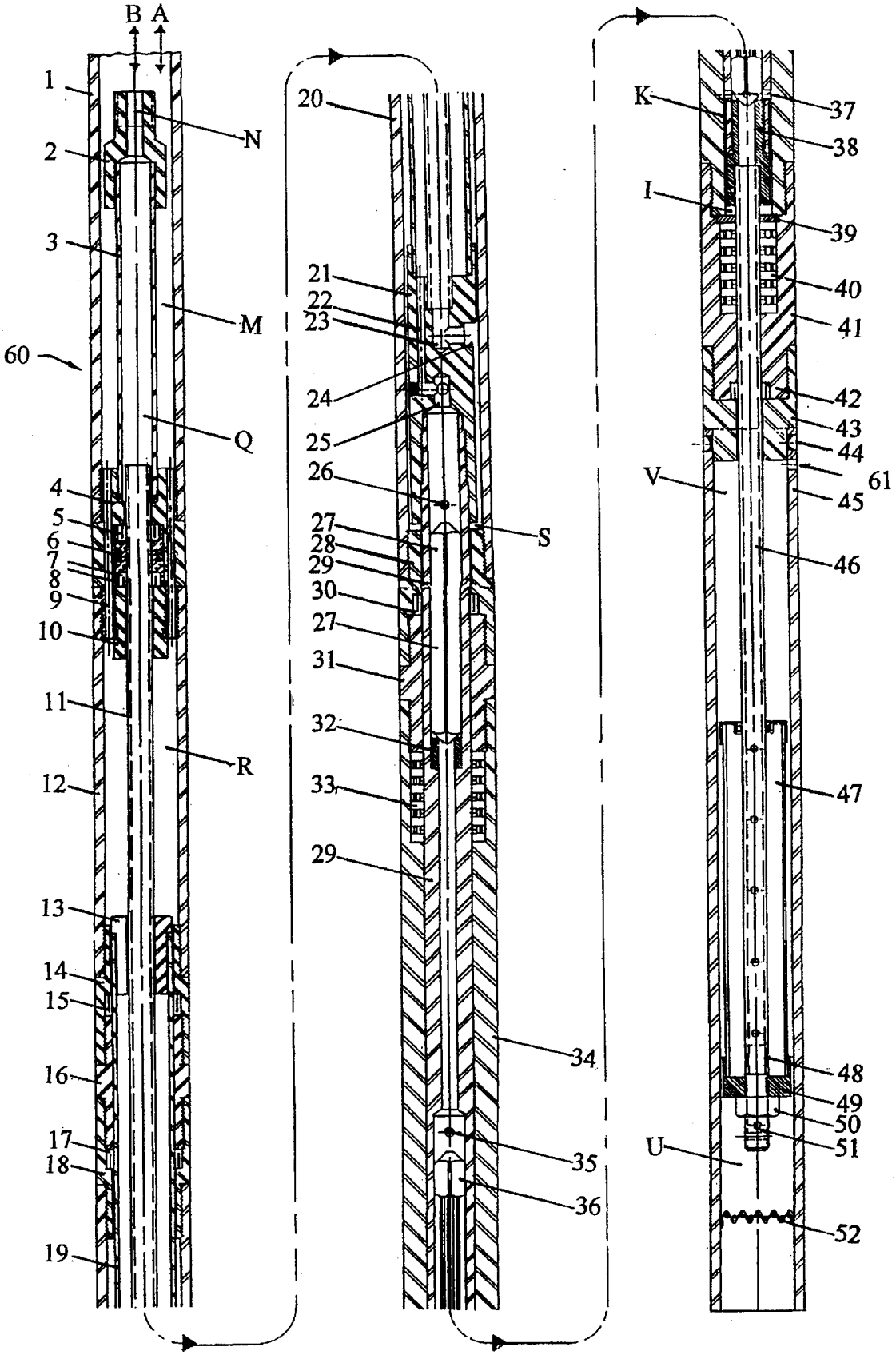

The present invention revolves around a pumping system that is intended for a small-enveloped (at least approximately 30 mm), single-acting, hydraulically-operated, reciprocating, deep-well, fluid-extraction pump 60 (i.e. "hydraulically-operated, deep-well pump") having installments of its motor fluid generator and of its control valving above ground. As shown in FIG. 1(*a*), FIG. 1(*b*), FIG. 1(*c*), FIG. 2(*a*) and FIG. 2(*b*), the hydraulically-operated, deep-well pump 60, in addition to having a production chamber M, is divided into a series of pressure chambers, comprising a production chamber M, a top, pressure chamber R, a middle, pressure chamber S, and a bottom, pressure chamber I (or a pumping chamber, D, in descending order from ground level downwards, and has a compound, stepped piston 19, comprising a telescopic, fluid line 11, a tubular, middle section 62 and a suction tube 46. Any hydraulic-well fluid, located below the bottom, pressure chamber I and above a safety screen 52 is classified into two portions: a top, hydraulic-well fluid V and a bottom, hydraulic-well fluid U.

The telescopic, fluid line 11 has a projected, annular area C, and the tubular, middle section 62 has a top, annular, piston area D, a middle, annular, piston area E, and a bottom, annular, piston area F, in descending order. Except for the existence of a connection through a number of free passages 9 between the production chamber M and the top, pressure chamber R, connections among the series of pressure chambers are established by the compound, stepped piston 19. The hydraulically-operated, deep-well pump 60 comprises an elongate tubular assembly with enclosing outer sleeves extending from ground level to the bottom, hydraulic-well fluid U, said outer sleeves comprising, in descending order: a top, tubular, outer sleeve 1, an upper-middle, tubular, outer sleeve 12, a middle, tubular, outer sleeve 20, a lower-middle, tubular, outer-sleeve 34 and a bottom, tubular, outer sleeve 45. The top, tubular, outer sleeve 1 surrounds and is coaxial with and concentric with a tubular sleeve 3 which is engaged at its upper end by a coupling 2, said coupling 2 connected at its own upper end to a top, tubular, inner sleeve extending to ground level in axial alignment with the top, tubular, outer sleeve 1. A central bore, extending, through the coupling 2 and through the top, tubular, inner sleeve, to the surface of the well and in axial alignment with the top, tubular, outer sleeve 1, acts as an annular, upper, central conduit N of any pumped, well fluid 101 into an above-ground, storage facility or deposit 100. A space that is simultaneously located outside the tubular sleeve 3 or outside the top, tubular inner sleeve and inside the top, tubular, outer sleeve 1 defines the production chamber M. Extending concentrically through and in axial alignment with the production chamber M are: the upper, central conduit N and an annular, lower, central conduit Q which is preferably larger in diameter than the upper, central conduit N and through which the telescopic, fluid line 11 of the compound, stepped piston 19 slides up and down, from the top, pressure chamber R to the lower, central conduit Q and vice versa.

The telescopic, fluid line 11 connects the lower, central conduit Q to the middle, pressure chamber S. The telescopic, fluid line 11 of the hydraulically-operated, deep-well pump 60 is coaxial with and concentric with the tubular sleeve 3 and is engaged at its upper end by lower end of the tubular sleeve 3. The engagement of the tubular sleeve 3 by the coupling 2 and of the telescopic, fluid line 11 by the tubular sleeve 3 define the lower, central conduit Q. A top seal assembly is used to strengthen connection of the telescopic, fluid line 11 with the top, tubular, outer sleeve 1 and with the upper-middle, tubular, outer sleeve 12 and connection of the top, tubular, outer sleeve 1 with the tubular sleeve 3 and with the upper-middle, tubular, outer sleeve 12, and to avoid leakage of any fluids through the above-listed connections.

In a preferred embodiment, said top seal assembly is concentric and coaxial with the telescopic, fluid line 11 and comprises a number of dynamic and static seals, a top, seal housing 4, and a seal retainer 10. The top, seal housing 4 comprises an inner, cylindrical section and an outer, cylindrical section that has a larger diameter than, is connected to and encompasses the inner, cylindrical section. Any space that is outside the inner, cylindrical section, but is inside the outer, cylindrical section, of the top, seal housing 4 defines the number of free passages 9. The top, seal housing 4 embraces the number of dynamic and static seals by its inner, cylindrical section and seals the top, tubular, outer sleeve 1 to the upper-middle, tubular, outer sleeve 12 by its outer, cylindrical section. In addition, through its inner, cylindrical section, the top, seal housing 4 concentrically and in axial alignment encompasses lower end of the tubular sleeve 3 and upper end of the telescopic, fluid line 11 and separates said number of dynamic and static seals from the tubular sleeve 3 and from the number of free passages 9.

The outer, cylindrical section of the top, seal housing 4 is also concentric and coaxial with the tubular sleeve 3 and with the telescopic, fluid line 11 and comprises: a middle portion, which separates the top, tubular, outer sleeve 1 from the upper-middle, tubular, outer sleeve 12, an upper portion and a lower portion, said upper portion and lower portion being thinner and having a smaller diameter than the middle portion, with the upper portion separating the top, tubular, outer sleeve 1 from the number of free passages 9 and with the lower portion separating the upper-middle, tubular, outer sleeve 12 from the number of free passages 9. The upper portion and the lower portion of the outer, cylindrical section of the top, seal housing 4 have external threads on their side adjacent to and are connected to lower end of the top, tubular, outer sleeve 1 and to upper end of the upper-middle, tubular, outer sleeve 12, respectively. The inner, cylindrical section of the top, seal housing 4 comprises: an upper portion, a middle portion, and a lower portion, said middle portion and said lower portion of the inner, cylindrical section of the top, seal housing 4 being narrower than its upper portion.

In a preferred embodiment, the number of dynamic and static seals of the top seal assembly comprises: a first, dynamic seal 5 positioned adjacent to the telescopic, fluid line 11, when top portion of the telescopic, fluid line 11 is inserted through the top seal assembly, and adjacent to and under the upper portion of the inner, cylindrical section of the top, seal housing 4; a second, dynamic seal 7 that is located above and adjacent to the seal retainer 10 and directly below and apart from the first, dynamic seal 5; a static seal 6 located apart from the first, dynamic seal 5 and from the second, dynamic seal 7, located apart from and in between the telescopic, fluid line 11 and the number of free passages 9, and separated from the number of free passages 9 by and located adjacent to the middle portion of the inner, cylindrical section of the top, seal housing 4; and a third, dynamic seal 8 separating the static seal 6 from the telescopic, fluid line 11, from the first, dynamic seal 5 and from the second, dynamic seal 7, separating the first, dynamic seal 5 from the second, dynamic seal 7, and separating the first, dynamic seal 5 and the second, dynamic seal 7 from the middle portion of the inner, cylindrical section of the top, seal housing 4.

The upper portion of the inner, cylindrical section of the top, seal housing 4 has an upper section that separates the lower end of the tubular sleeve 3 from the number of free passages 9 and has a lower section that, in addition to serving as a support for the lower end of the tubular sleeve 3, separates the tubular sleeve 3 from the first, dynamic seal 5 and from the third, dynamic seal 8 and separates the telescopic, fluid line 11 from the number of free passages 9. The middle portion of the inner, cylindrical section of the top, seal housing 4 and the number of dynamic and smile seals of the top, seal assembly are retained by the seal retainer 10. In addition, a side of the lower portion of the inner, cylindrical section of the top, seal housing 4 is joined with an internal thread to an upper portion of the seal retainer 10, thus, separating the upper portion of the seal retainer 10 from the number of free passages 9 while leaving a lower portion of the seal retainer 10 in contact with the number of free passages 9. Said top, seal assembly holds the telescopic, fluid line 11, the tubular sleeve 3, the top, tubular, outer sleeve 1 and the upper-middle, tubular, outer sleeve 12 in a stable position, facilitating engagement of the upper end of the telescopic, fluid line 11 by the lower end of the tubular sleeve 3, while establishing the number of free passages 9.

A space existing inside the upper-middle, tubular, outer sleeve 12 but outside the telescopic, fluid line 11 defines the top, pressure chamber R which receives any fluid descending through the number of free passages 9. The top, pressure chamber R separates the seal retainer 10 from a slotted, guide bushing 13 which is located below the seal retainer 10 and which is coaxial with and concentric with the telescopic, fluid line 11. The slotted, guide bushing 13 guides the compound, stepped piston 19 along the upper-middle, tubular, outer sleeve 12, affecting size of the top, pressure chamber R. Meanwhile, a portion of the slotted, guide bushing 13 provides a passageway for downward flow of any fluid from the top, pressure chamber R to the bottom, pressure chamber I or upward flow of any fluid from the bottom, pressure chamber I into the top, pressure chamber R.

In its most preferred embodiment, the compound, stepped piston 19 is reciprocably mounted within and is concentric with and coaxial with the upper-middle, tubular, outer sleeve 12, the middle, tubular, outer sleeve 20, the lower-middle, tubular, outer sleeve 34 and the bottom, tubular, outer sleeve 45. Another seal assembly connects the upper-middle, tubular, outer sleeve 12 to the middle, tubular, outer sleeve 20 and prevents passage of fluids from the upper-middle, tubular, outer sleeve 12 to the middle, tubular, outer sleeve 20 outside of the compound, stepped piston 19. A second, upper-middle, seal housing 16 is concentric with and coaxial with the compound, stepped piston 19 and comprises a middle portion, which is positioned between a first, upper-middle, seal housing 14 and a third, upper-middle, seal housing 18, an upper portion, which is positioned between the first, upper-middle seal housing 14 and the compound, stepped piston 19, and a lower portion, which is positioned between the third, upper-middle, seal housing 18 and the compound, stepped piston 19. The first, upper-middle, seal housing 14 and the third, upper-middle, seal housing 18 each has an upper portion and a lower portion, with the upper portion of each seal housing running parallel to its lower portion and with lower end of the upper portion being connected sidewise to upper end of its lower portion. The upper portion and the lower portion of the second, upper-middle seal housing 16 are joined with an external thread to the lower portion of the first, upper-middle, seal housing 14 and to the upper portion of the third, upper-middle, seal housing 18, respectively. The upper portion of the first, upper-middle, seal housing 14 is connected with an external thread to a lower end of the upper-middle, tubular, outer sleeve 12. Similarly, the lower portion of the third, upper-middle, seal housing 18 is externally threaded to an upper end of the middle, tubular, outer sleeve 20. A dynamic seal 15 is positioned below the upper portion of the first, upper-middle, seal housing 14, above the upper portion of the second, upper-middle seal housing 16, and between the compound, stepped piston 19 and the lower portion of the first, upper-middle, seal housing 14. Another dynamic seal 17 is positioned below the lower portion of the second, upper-middle seal housing 16, above the lower portion of the third, upper-middle, seal housing 18 and between the compound, stepped piston 19 and the upper portion of the third, upper-middle, seal housing 18.

The compound, stepped piston 19 has a portion serving as a manifold 21 which establishes several connections between different parts of the hydraulically-operated, deep-well pump 60. A fluid passage 22 connects the top, pressure chamber R to the bottom, pressure chamber I, while avoiding any connections between the top, pressure chamber R and the middle, pressure chamber S, providing a passage from the top, pressure chamber R through the slotted, guide bushing 13 to the bottom, pressure chamber I. The fluid passage 22 leads to a fluid collector 25. A production fluid-discharge, pump-valve means, comprising an upper, check valve 27 adjacent to an upper, cross pin 26, is positioned inside an intensifier piston 29 on path of the fluid passage 22. The upper, cross pin 26 assists the upper, check valve 27 in preventing high-velocity rises due to fluid impact. Meanwhile, the telescopic, fluid line 11, which connects the lower, central conduit Q only to the middle, pressure chamber S, is connected to a lateral outlet 23 which is, in turn, connected to a cross conductor 24. The cross conductor 24 leads to the middle, pressure chamber S which is defined as the space between the middle, tubular, outer sleeve 20 and the manifold 21 and, above the manifold 21, between the middle, tubular, outer sleeve 20 and the compound, stepped piston 19. An upper end of the intensifier piston 29 above the upper, check valve 27 is joined with an external thread to the surrounding manifold 21 which is neighboring the middle, pressure chamber S. A first, lower-middle, seal housing 28 is positioned below the middle, pressure chamber S and adjacent to the intensifier piston 29 and comprises an upper portion and a lower portion, with the upper portion running parallel to its lower portion and with lower end of the upper portion being connected sidewise to upper end of its lower portion. The upper portion of the first, lower-middle, seal housing 28 is joined with an external thread to a lower end of the middle, tubular, outer sleeve 20. Where the middle, tubular, outer sleeve 20 ends, the lower portion of the first, lower-middle, seal housing 28 is positioned under the middle, tubular, outer sleeve 20 and continues downwards adjacent to and concentric with the intensifier piston 29.

A number of dynamic seals 30 exists under and adjacent to the upper portion of the first, lower-middle, seal housing 28 and between the lower portion of the first, lower-middle, seal housing 28 and the intensifier piston 29, and then, under the number of dynamic seals 30, an upper portion of a second, lower-middle, seal housing 31 exists which is adjacent to and coaxial and concentric with the intensifier piston 29. The lower portion of the first, lower-middle, seal housing 28 is joined with an internal thread to the upper portion of the second, lower-middle, seal housing 31. Where the first, lower-middle, seal housing 28 terminates, the second, lower-middle seal housing 31 thickens into a middle portion that supports the first, lower-middle, seal housing 28. Appearance of the lower-middle, tubular, outer sleeve 34 results in a decrease in the thickness of a lower portion of the second, lower-middle, seal housing 31. The lower portion of the second, lower-middle, seal housing 31 is joined with an external thread to an upper end of the lower-middle, tubular, outer sleeve 34. The lower portion of the second, lower-middle, seal housing 31 is positioned on a number of upper, dynamic, self-adjusting, fluid seals 33 that are concentric with and surround a section of the intensifier piston 29. The upper, check valve 27 rests on and ends at an upper, cylindrical piston 32 which is positioned on a horizontal circular surface formed by an increase in thickness of the intensifier piston 29 and which is, thus, encompassed by a portion of and is concentric with and coaxial with the intensifier piston 29 of the lower thickness.

The intensifier piston 29 continues downwards, creating a passageway to a production fluid-inlet, pump-valve means comprising a suction, check valve 36 (located below the upper, check valve 27) adjacent to a lower, cross pin 35, said passageway being concentric with and coaxial with the intensifier piston 29. The lower, cross pin 35 assists the suction, check valve 36 in preventing high-velocity rises due to fluid impact. An increase in thickness in the lower-middle, tubular, outer sleeve 34 and in the intensifier piston 29 below the second, lower-middle, seal housing 31 deletes any necessity for any additional elements to be used for limiting empty space solely to the passageway extending through the intensifier piston 29. The passageway increases in diameter where the lower, cross pin 35 and the suction, check valve 36 are positioned. Radial holes 37, positioned below the production fluid-discharge, pump-valve means and towards lower end of the intensifier piston 29, in addition to separating the upper, check valve 27 from the suction, check valve 36, serve as an opening for material being transferred into and out of the bottom, pressure chamber I. The suction, check valve 36 is positioned on a lower, cylindrical piston 38 (i.e. an injection piston 38) which is concentric with and coaxial with the suction, check valve 36 and which has an upper section and a lower section. The upper section of the lower, cylindrical piston 38 is joined with an external thread to a lower end of the intensifier piston 29.

The upper, check valve 27 and the suction, check valve 36 are operated by force of gravity and are basically designed, using weight of the polygonal, compound, stepped piston 19 with tapered ends, in order to make a fluid-tight seal against the upper, cylindrical piston 32 and against the lower, cylindrical piston 38, respectively. In addition, the upper, check valve 27 and the suction, check valve 36 are designed to allow free flow in an opposite direction whenever any differential fluid-pressure force, acting upon projected area either of the upper, cylindrical piston 32 or of the lower, cylindrical piston 38, respectively, exceeds the weight of the upper, check valve 27 and of the suction, check valve 36. For the upper, check valve 27 and for the suction, check valve 36, based on the weight of the upper, check valve 27 and of the suction, check valve 26, respectively, a cracking pressure is adjusted to require less than 0.5 $kg/cm^2$ differential pressure and is usually between about 0.2 $kg/cm^2$ to about 0.35 $kg/cm^2$. The upper, check valve 27 and the suction, check valve 36 of the polygonal design have rounded corners, which center the upper, check valve 27 and of the suction, check valve 36, respectively, within each bore in the intensifier piston 29 wherein each check valve is located, while still allowing ample, pressurized, fluid flow past the compound, stepped piston 19 through the channels between flats of each polygonal check valve and valve bores in the compound, stepped piston 19, and develop a durable design, without requiring any delicate bias springs used in valves. The upper, check valve 27 and the suction, check valve 36 of the compound, stepped piston 19 have an upstroke which is limited with the upper, cross pin 26 and with the lower, cross pin 35, respectively, in order to allow full unrestricted fluid flow at any free flow direction.

An empty space in middle of the lower, cylindrical piston 38 defines a passageway which is coaxial and concentric with the lower-middle, tubular, outer sleeve 34 and is located between the suction, check valve 36 and the suction tube 46, with the suction tube 46 being concentric and in axial alignment with the passageway through the lower, cylindrical piston 38. Where the suction tube 46 enters and exits the lower, cylindrical piston 38, any space located outside the suction tube 46 and inside the lower-middle, tubular, outer sleeve 34 defines the bottom, pressure chamber I. The lower, cylindrical piston 38 through radial clearance K connects the radial holes 37 to the bottom, pressure chamber I. A number of lower, dynamic, self-adjusting, fluid seals 40, being concentric and coaxial with the suction tube 46, is separated by a spacer 39, which is also concentric and coaxial with the suction tube 46, from the bottom, pressure chamber I and from the lower-middle, tubular, outer sleeve 34. The number of lower, dynamic, self-adjusting, fluid seals 40 is supported by a bottom, seal housing 41 that is concentric and coaxial with the suction tube 46. The bottom, seal housing 41 has an upper portion, a middle portion and a lower portion, with the upper portion being thinner than the middle portion and with the bottom portion having a smaller diameter than the middle portion. The upper portion of the bottom, seal housing 41 having internal threads embraces a lower end of the lower-middle, tubular, outer sleeve 34 that has been reduced in cross-section. An adapter 43, that is concentric and coaxial with the suction tube 46, follows the bottom, seal housing 41 and comprises an upper portion, a middle portion and a lower portion, with the middle portion being larger in diameter than the lower portion and is thicker than the upper portion. The lower portion of the bottom, seal housing 41 is joined with an external thread to the upper portion of the adapter 43. Dynamic seals 42 are positioned at the lower portion of the bottom, seal housing 41 and are located adjacent to and coaxial and concentric with the suction tube 46 and adjacent to the middle portion, but apart from the upper portion, of the adapter 43. The middle portion of and the lower portion of the adapter 43 embrace the suction tube 46 where the bottom, seal housing 41 ends. At its lower portion, the adapter 43 is encircled by and fastened, by plug welding (please refer to "44" on FIG. 1(*c*)) or threading (not shown), to the bottom, tubular, outer sleeve 45.

A space that is located inside the bottom, tubular, outer sleeve 45, outside the suction tube 46, and between the adapter 43 and a dynamic, suction filter 47 contains the top, hydraulic-well fluid V. The dynamic, suction filter 47 is connected at its bottom to the suction tube 46. A sealed metal cover is positioned on top of the dynamic, suction filter 47. The dynamic, suction filter 47 has a lower end 48 that is positioned in and is joined with external threads to a bottom cover 49. The space that is located inside the bottom, tubular, outer sleeve 45 but outside the dynamic, suction filter 47 defines a narrow passageway which connects the top, hydraulic-well fluid V to the bottom, hydraulic-well fluid U. The narrow passageway between the top, hydraulic-well fluid V and the bottom, hydraulic-well fluid U is the path through which any top, hydraulic-well fluid is transmitted downward when the dynamic, suction filter is moved upward and through which any bottom, hydraulic-well fluid is transmitted upward when the dynamic, suction filter 47 is moved downward. It is this up-and-down transmittal of hydraulic-well fluid that prevents any collection of sand and other particles on the fine-mesh, preferably fine stainless-steel, screen of the dynamic, suction filter 47. With the hydraulic-well fluid moving at a higher velocity downwards than upwards, a larger amount of sand and particles is flushed when the top, hydraulic-well fluid V is moving downwards than when the bottom, hydraulic-well fluid U is moving upwards. A threaded core 51 is used to plug the lower end 48 of the suction tube 46. The threaded core 51 is welded to the lower end 48 of the suction tube 46 and is fastened by a lock nut 50, with its threaded portion being threaded to bottom cover 49 of the dynamic, suction filter 47. Two holes, through which a cross pin is used, are set at the lower end of the threaded core 51 in order to prevent the lock nut 50 from falling when loose. Below the threaded core 51 is the safety screen 52 fastened into the bottom, tubular, outer sleeve 45, which in addition to screening any matter flowing therethrough can also serve as a barrier for any falling accidentally damaged parts.

Another important feature of the hydraulically-operated, deep-well pump 60 is that the hydraulically-operated, deep-well pump 60 is designed to avoid gas locks (i.e. gas that collects in the top, hydraulic-well fluid V, thus preventing normal flow and operation of the hydraulically-operated, deep-well pump 60). One or more bleed holes 61 exist at the upper end of the bottom, tubular, outer sleeve 45 for purging out any gas that collects in the top, hydraulic-well fluid V of the hydraulically-operated, deep-well pump 60.

Figure 3:
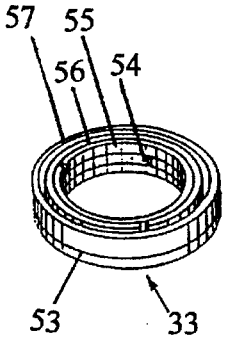
FIG. 3 illustrates an isometric view of a section of an individual, ridged, dynamic, fluid seal for the hydraulically-operated, deep-well, fluid-extraction pump demonstrated in FIG. 1(*a*), FIG. 1(*b*), and FIG. 1(*c*).
Figure 4:
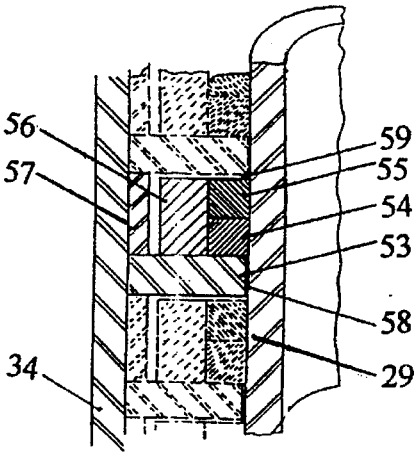
FIG. 4 is an enlarged, vertical, cross-sectional view of the section of the individual, ridged, dynamic, fluid seal demonstrated in FIG. 1(*a*), FIG. 1(*b*), FIG. 1(*c*) and FIG. 3.

In reference to seals used in the hydraulically-operated, deep-well pump 60, the most preferred embodiment of the number of upper, dynamic, self-adjusting, fluid seals 33 (and of the number of lower, dynamic, self-adjusting, fluid seals 40) is metallic or polymeric and is illustrated in FIG. 1(*b*) and FIG. 1(*c*) and, more explicitly, in FIG. 3 and FIG. 4. Function of fluid seals is based upon a dynamic, pressure drop of turbulent, axial flow through a plurality of closely-controlled, radial clearances 58 (as shown in FIG. 4), and a plurality of closely-fitting, seal rings 54 and 55 (as shown in FIG. 3 and FIG. 4). The plurality of closely-fitting, seal rings 54 and 55 have split openings which are positioned at approximately 120° with respect to other split openings, have male members, are generally made of ferrous or polymeric material, and are manufactured with a slight diametral interference fit with the intensifier piston 29. In order to mount the plurality of closely-fitting, seal rings 54 and 55 each over its own male member, the split openings are initially forced open and biased radially inwards by a spring ring 56, with split lines fazed at about 120° between the split openings of the plurality of closely-fitting, seal rings 54 and 55. The plurality of closely-fitting, seal rings 54 and 55, together with the spring ring 56, are axially approximately 20 micrometers to approximately 100 micrometers shorter than a non-split, spacer ring 57 that is placed adjacent to a tubular, outer sleeve (the lower-middle, tubular, outer sleeve 34 in FIG. 4). The plurality of closely-fitting, seal rings 54 and 55, the spring ring 56, and the non-split, spacer ring 57 are housed between each pair of pressure-drop rings 53 (shown in FIG. 3 and FIG. 4). Assuming that the fluid pressure at top of the plurality of closely-fitting, seal rings 54 and 55 is higher than any opposing pressure, the fluid will tend to pass by between the intensifier piston 29 and the pressure-drop rings 53.

Since the plurality of closely-controlled, radial clearances 58 are relatively small, the axial, turbulent, fluid flow experiences substantial pressure drop. Any fluid which passes any pair of pressure-drop rings 53 will seep through an axial clearance 59, will flow behind the spring ring 56, and will start to exert a radially inward pressure on the plurality of closely-fitting, seal rings 54 and 55. This radially inward pressure, combined with reciprocating motion of the intensifier piston 29, will wear the bore of the plurality of closely-fitting, seal rings 54 and 55 in order to conform to the contour of the sliding intensifier piston 29. The wear of the bore of the plurality of closely-fitting, seal rings 54 and 55 proceeds until the split ends are butted. At the moment when the plurality of closely-fitting, seal rings 54 and 55 are precisely conforming to the outer diameter of the intensifier piston 29, a clearance of approximately zero to a few micrometers exists and an almost perfect barrier for axial oil leakage is developed. The plurality of closely-fitting, seal rings 54 and 55, along with the spring ring 56, are free floating in the space provided with the non-split spacer ring 57 and any pair of pressure-drop rings 53, constantly centered by the intensifier piston 29, and pressure biased at the outside diameter of the spring ring 56. Each set of the plurality of closely-fitting, seal rings 54 and 55, along with pressure-drop rings 53, produce a pressure drop of approximately 100 kg/cm$^2$, depending on the viscosity of the oil and the stage of wear-in of the plurality of closely-fitting, seal rings 54 and 55.

An alternate option that is available for less-elaborate, dynamic seals (as shown by "5", "7", "8", "15", "17", "30" and "42" in FIG. 1(*a*), FIG. 1(*b*) and FIG. 1(*c*)) are polymeric seals, elastomeric seals or any combination thereof. Polymeric and/or elastomeric seals can be used for more benign working conditions. Any polymeric and/or elastomeric seals can replace the longer-lasting dynamic, self-adjusting, fluid seals (as shown by "33" and "40" in FIG. 1(*b*) and FIG. 1(*c*), respectively).

The hydraulically-operated, deep-well pump 60, having a diameter of at least 30 mm (a diameter of preferably approximately 38 mm), may be provided with sufficient side clearance to allow the hydraulically-operated, deep-well pump 60 to be installed in bowed and angular, as well as horizontal, wells.

OPERATION OF HYDRAULIC POWER CONTROL SYSTEM

Figure 2A:
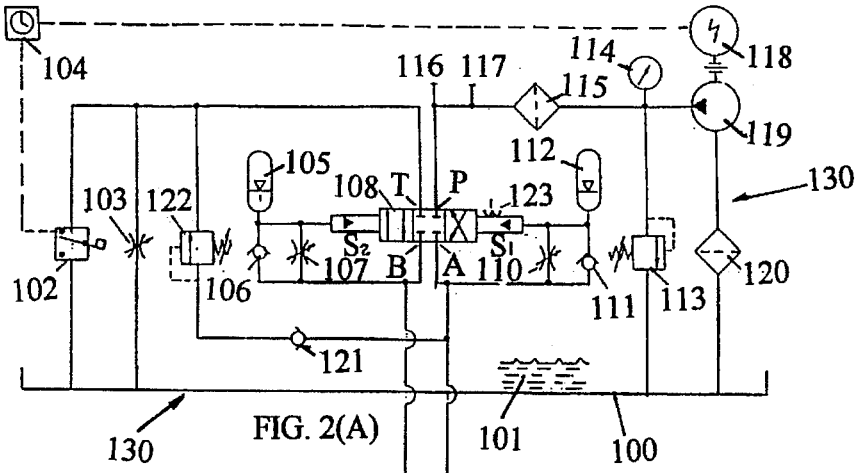
FIG. 2(*a*) shows a central, hydraulic power station of the hydraulically-operated, deep-well, fluid-extraction pump demonstrated in FIG. 1(*a*), FIG. 1(*b*) and FIG. 1(*c*).
Figure 2B:
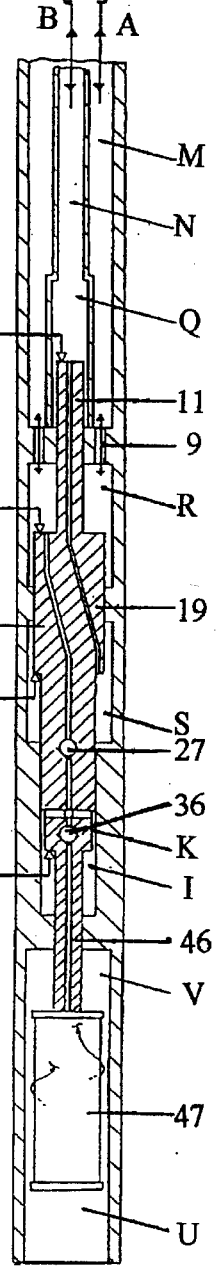

A hydraulic-power, control circuit 130 is represented in FIG. 2(*a*), in combination with FIG. 2(*b*). Hydrostatic pressure generated by a hydraulic pump 119 (i.e. "pump hydrostatic pressure") energizes a pressure port P of a four-port, fluid-flow, directional, control valve 108 (referred to hereinafter as "four-port, control valve" and shown in FIG. 2(*a*)). The pressure port P, then, directs the fluid flow to a production-chamber, outlet port A and, alternately and consecutively, to a central-conduit, outlet port B. While the pressure port P is directing fluid flow to an outlet port, return flow is forwarded through the other outlet port (and through a complementary route when the return flow is forwarded to the production-chamber, outlet port A) to a deposit port T. Upon timed commands, conduction of pressurized fluid flow is reversed by the four-port, control valve 108 depicting the production-chamber, outlet port A, the central-conduit, outlet port B, the deposit port T and the pressure port P.

A time allowed for an adjustable pumping cycle (referred to as "suction stroke" and "pumping stroke") is individually defined by an interaction between a left, flow-control valve 107 and a right, flow-control valve 110, and their corresponding accumulators, a left, hydro-pneumatic accumulator 105 and a right, hydro-pneumatic accumulator 112, of a right-pilot, circuit operator $S_1$ and of a left-pilot, circuit operator $S_2$, respectively, operated through the four-port, control valve 108. The pumping cycle is initiated by the four-port, control valve 108, with the right-pilot, circuit operator $S_1$ energized, when the pressure port P is directed to the central-conduit, outlet port B and when the production-chamber, outlet port A is connected to the deposit port T. The pressurized hydraulic fluid from the central-conduit, outlet port B is directed to the middle, pressure chamber S, from the hydraulically-operated, deep-well pump 60 to act upon the middle, annular, piston area E and to elevate the compound, stepped piston 19 (please refer to FIG. 2(*b*)). Outlet port B, which is also energized by fluid hydrostatic pressure existing in the hydraulically-operated, deep-well pump 60, is energized by the pump hydrostatic pressure of the hydraulic pump 119, resulting in an excess pressure of outlet port B over pressure of outlet port A, which is only energized, at this stage, by an equivalent fluid hydrostatic pressure of the hydraulically-operated, deep-well pump 60. With outlet port B having an excess hydrostatic pressure over outlet port A, the excess hydrostatic pressure forces the fluid through the upper, central conduit N and then into the lower, central conduit Q wherefrom the fluid pressure is exerted on the projected, annular area C of the compound, stepped piston 19, and down through the telescopic, fluid line 11.

The fluid in the lower, central conduit Q is pushed through the telescopic, fluid line 11 to the middle, pressure chamber S, filling the middle, pressure chamber S and exerting pressure upwards on the middle, annular, piston area E simultaneously as pressure is being exerted downwards on the projected, annular area C. With the middle, annular, piston area E being larger than the projected, annular area C, the hydraulic force exerted on the projected, annular area C is smiler than the force exerted on the middle, annular, piston area E which forces the compound, stepped piston 19 to move upwards, filling up the middle, pressure chamber S by fluid through the telescopic, fluid line 11 and forcing the fluid in the top, pressure chamber R up through the number of free passages 9 into the production chamber M. The increased pressure in the production chamber M leads to discharge of fluid from the production-chamber, outlet port A through the deposit port T to the deposit 100.

The bottom, pressure chamber I is filled with fluid from the bottom, hydraulic-well fluid U and the top, hydraulic-well fluid V during an upstroke (as shown in FIG. 2(*a*) in combination with FIG. 2(*b*)). During the upstroke, or suction stroke, due to atmospheric pressure and static head of the bottom; hydraulic-well fluid U, the bottom, hydraulic-well fluid U is pushed through the dynamic, suction filter 47 to the bottom, pressure chamber I which has been previously evacuated. Force exerted under the middle, annular, piston area E of the compound, stepped piston 19 raises the compound, stepped piston 19, starling the upstroke. The hydraulic-well fluid is pushed upwards through the dynamic, suction filter 47, the suction tube 46 and the suction, check valve 36, to exit through radial holes 37 into the evacuated, bottom, pressure chamber I, leading to filling of the bottom, pressure chamber I with bottom, hydraulic-well fluid U. During each upstroke, some gas is separated from the bottom, hydraulic-well fluid U due to a sudden pressure drop of an incoming fluid flow, forming gas bubbles at the top of each fluid pool created by the incoming fluid flow. When the lower, cylindrical piston 38 is lowered, the gas bubbles are first to be ejected out through radial clearances K and cross holes 37 before any other injections occur. The gas bubbles are also reabsorbed by the pressurized fluid and transported by the remaining pressurized fluid.

The entering bottom, hydraulic-well fluid U is filtered by the screen of the dynamic, suction filter 47 serving as a strainer. While the hydraulic-well fluid is being pushed through the dynamic, suction filter 47 to the evacuated, bottom, pressure chamber I, since the dynamic, suction filter 47 is connected to the lower end of the suction tube 46, during each lifting of the compound, stepped piston 19 in each upstroke, the dynamic, suction filter 47 is elevating. The upward movement of the dynamic, suction filter 47 reciprocates a downward (i.e. reversed), high-velocity, pressurized flow of the top, hydraulic-well fluid V through the narrow clearance existing between the dynamic, suction filter 47 and the bottom, tubular, outer sleeve 45. It is this downward, hydraulic-well fluid flow which is responsible for dislodging of a majority of sand, as well as other, particles that have been deposited on the screen of the dynamic, suction filter 47 by a previous suction cycle. Due to the reciprocating motion of the dynamic, suction filter 47 occurring in a confined space within the bottom, tubular, outer sleeve 45, reversed, pressurized, top, hydraulic-well fluid V is displaced from a space above the dynamic, suction filter 47 and is pushed downwards where a portion of the displaced, reversed, pressurized fluid enters through the screen of the dynamic, suction filter 47 to fill the bottom, pressure chamber I. Meanwhile, a greater portion of the displaced, reversed, pressurized fluid is rushed down, past the dynamic, suction filter 47 and through the confined space between the dynamic, suction filter 47 and the bottom, tubular, outer sleeve 45, dislodging or washing down any loose sand, and other, particles deposited on the fine-mesh screen of the dynamic, suction filter 47. A comparable flushing action of the screen by upward, pressurized, high-velocity, flow of bottom, hydraulic-well fluid U occurs during each downstroke (i.e. during each pumping cycle) of the dynamic, suction filter 47, but in opposite direction to the flow of hydraulic-well fluid during each upstroke of the dynamic, suction filter 47. The downward movement of the dynamic, suction filter 47 causes an upward, high-velocity, pressurized flow of the bottom, hydraulic-well fluid U through the narrow clearance between the dynamic, suction filter 47 and the bottom, tubular, outer sleeve 45, dislodging any remaining particles on the screen of the dynamic, suction filter 47. Thus, the pressurized, high-velocity, hydraulic-well fluid flow flushes the screen of the dynamic, suction filter 47 during each upstroke and downstroke of the dynamic, suction filter 47. The flushing action renovates the efficiency of the fine-mesh screen of the dynamic, suction filter 47 during each half-cycle of the hydraulically-operated, deep-well pump 60. The flushing action also allows use of a considerably freer mesh in manufacturing the screen of the dynamic, suction filter 47 than in manufacturing screens for static filters.

After an appropriate time delay (i.e. a fraction of a second to a few seconds), the left-pilot, circuit operator $S_2$ of the four-port, control valve 108 reverses the flow pattern of pressurized hydraulic fluid, where the pressure port P is aligned with the production-chamber, outlet port A, and return flow from the central-conduit, outlet port B is conducted through the deposit port T into the deposit 100, using the flow-restriction valve 103, with overflow being directed to the flow-sensor switch 102. The hydraulic overpressure from the production-chamber, outlet port A is conducted through the production chamber M and the number of free passages 9 to the top, pressure chamber R, and acting upon the top, annular, piston area D, lowers the compound, stepped piston 19.

An axial force is developed on the compound, stepped piston 19 and transmitted from the top, annular, piston area D to the bottom, annular, piston area F. The axial force exerted upon the top, annular, piston area D by the pressure of the reversed pressurized fluid flow from the production-chamber, outlet port A results in an increased hydraulic pressure on the bottom, pressure chamber I due to a lower, active, piston area offered by the bottom, annular, piston area F. As a result, the compound, stepped piston 19, the top, annular, piston area D and the lower, cylindrical piston 38 form a differential fluid-pressure injection assembly where the ratio of the top, annular, piston area D to the bottom, annular, piston area F is a factor of fluid pressure intensification in the bottom, pressure chamber I. The ratio of pressure intensification (i.e. the ratio of the top, annular, piston area D to the bottom, annular, piston area F) can be any number greater than one, as long as friction of dynamic fluid seals, fluid friction of pipes, and cracking pressure of the upper, check valve 27 are overcome. In a most preferred embodiment, the ratio of pressure intensification of the top, annular, piston area D to the bottom, annular, piston area F is two to one (2:1). For example, if the ratio of the top, annular, piston area D to the bottom, annular, piston area F is equal to two and a fluid pressure of 100 kg/cm$^2$ is exerted upon the top, annular, piston area D, an intensified fluid pressure of 200 kg/cm$^2$ (i.e. 2×100 kg/cm$^2$) is exerted upon the bottom, annular, piston area F.

Any increased hydraulic force on the smaller, bottom, annular, piston area F creates an intensified (or boosted) pressure resulting in reverse injection of the compressed fluid from the bottom, pressure chamber I, causing an evacuation of the bottom, pressure chamber I. Any increased hydraulic pressure created in the bottom, pressure chamber I that is sufficient to open up the upper, check valve 27, forces fluid from the bottom, pressure chamber I through radial clearances K of the lower, cylindrical piston 38 and the radial holes 37 into the top, pressure chamber R and then into the production chamber M. From the production chamber M, fluid flows to the production-chamber, outlet port A. During boosted pressures, a check valve 121, that is connected to the line leading from the production chamber M to the production-chamber, outlet port A, also opens up and provides a path for a potion of the fluid flowing to the production-chamber, outlet port A. The check valve 121 is followed by a relief valve 122, wherefrom the fluid flows to the flow-restriction valve 103 and the flow-sensor switch 102. Thus, an optional route to the flow-restriction valve 103 is provided during a boosted pressure cycle.

While fluid is flowing from the bottom, pressure chamber I through the upper, check valve 27 to the production chamber M, fluid from the middle, pressure chamber S is displaced through the telescopic, fluid line 11, the lower, central conduit Q, and the central-conduit, outlet port B to the deposit port T and, along with fluid from the production chamber M passing through the flow-restriction valve 103, to the deposit 100.

Consecutively, the right-pilot, circuit operator $S_1$ is energized and the flow pattern of pressurized, hydraulic fluid reverses to crossed-flow porting and the pressure port P is aligned with the central-conduit, outlet port B once again, while the production-chamber, outlet port A is aligned with the deposit port T.

Hydraulic pressure from the pressure port P, after having passed through the central-conduit, outlet port B, the coupling 2, the tubular sleeve 3, and the telescopic fluid line 11 and upon collecting in the middle, pressure chamber S, acts upon the middle, annular, piston area E and elevates the compound, stepped piston 19 to develop a suction in the bottom, pressure chamber I. Development of this suction cavity in the bottom, pressure chamber I opens a space for the flow of bottom, hydraulic-well fluid U and top, hydraulic-well fluid V through the dynamic suction filter 47 within the bottom, tubular, outer sleeve 45, through a suction, check valve 36 to discharge through radial holes 37, and radial clearance K of the lower, cylindrical piston 38 into the bottom, pressure chamber I.

A hydraulic, fluid, pressure-generation and switching circuit is demonstrated in FIG. 2(*a*). The pressure generation and switching circuit is self-cycling, based on a time allowed for the pumping cycle and for the suction cycle, with duration of each cycle being individually adjustable. The hydraulic-power, control circuit 130 is shown with the four-port, control valve 108 conducting hydraulic, fluid flow in a consecutive switch between parallel-flow porting and crossed-flow porting as represented by the arrows within valve envelope of FIG. 2(*a*). The four-port, control valve 108 is fluid pilot operated and detent 123 retained at two extreme positions where the cyclic reciprocation frequency is determined by a left, flow-control valve 107 and a right, flow-control valve 110 in a so-called "bleed-in" fashion. A left, hydro-pneumatic accumulator 105 and a right, hydro-pneumatic accumulator 112 are used to provide the elasticity required for operation of the switching circuit. For example, with the four-port, control valve 108 being shifted to far left from a previous flow path, the hydraulic pressure of left line of the central-conduit, outlet port B is metered through the left, flow-control valve 107, in the timing circuit, to compress a gas in the left, hydro-pneumatic accumulator 105, until the pressure of compressed gas, upon pilot fluid, exceeds the holding force of an opposing detent 123, causing left-pilot, circuit operator $S_2$ of the four-port, control valve 108 suddenly to make a full shift to the right. Meanwhile, the right, hydro-pneumatic accumulator 112 at right-pilot, circuit operator $S_1$ has already exhausted the previously pressurized fluid, through a check valve 111 and a right, flow-control valve 110.

After a switch-over of the four-port, control valve 108, the pressurized fluid is conducted from the pressure port P to the production-chamber, outlet port A, and from right line of the production-chamber, outlet port A pilot pressure flow is metered through the right, flow-control valve 110 to the right, hydro-pneumatic accumulator 112, compressing the gas in the right, hydro-pneumatic accumulator 112 to a point where the gas pressure upon the right-pilot, circuit operator $S_1$ exceeds the holding force of the opposing detent 123, and the four-port, control valve 108 suddenly shifts over leftwards. The pressure port P, connected to the central-conduit, outlet port B, and the production-chamber, outlet port A, connected to the deposit port T, discharge. Meanwhile, the left, hydro-pneumatic accumulator 105 has already exhausted the previously pressurized fluid through a left, check valve 106 and through the left, flow-control valve 107. The deposit port T leads to the deposit 100. The production flow of well fluid from the deposit port T to the deposit 100 is restricted with the flow-restriction valve 103 to develop a slight backpressure, any overflow being directed through the flow-sensor switch 102. The flow-sensor switch 102 responds only to an excess flow and does not respond to a limited, return flow of either the right-pilot, circuit operator $S_1$ or the left-pilot, circuit operator $S_2$. With the presence of excess flow, the electrical contact of the flow-sensor switch 102 is open and a timer 104 being used is reset to zero. At the cessation of the return flow, the flow-sensor switch 102 establishes an electrical circuit to the timer 104 and in turn stops drive motor 118 of the hydraulic pump 119 in order to provide a predetermined, time cycle for well recovery. Thus, the flow-sensor switch 102 plays a role in changing the flow pattern from parallel-flow porting to crossed-flow porting.

After a predefined, time period, the timer 104 starts the hydraulic pump 119 anew. The hydraulic pump 119 will continue to operate as long as the flow of production fluid keeps the electrical contact of the flow-sensor switch 102 open. Dependence of operation of the hydraulic pump 119 on the flow of production fluid (i.e. on presence or absence of production fluid) saves the hydraulic pump 119 from "dry" wear and permits selection of an optimum, well-recovery cycle by the operator. The hydraulic pump 119 is protected from overpressure, and pressure peaks, by an adjustable, overpressure, relief valve 113. The maximum pressure setting of the overpressure, relief valve 113 is indicated by a pressure gauge 114. Inlet of the hydraulic pump 119 is protected from damage by large particles by a suction filter 120. The hydraulic-power, control circuit 130 has temporarily-closed outlets 116 and 117 for future expansion, to supply a pressurized hydraulic fluid to one or more nearby deep-well, pump-drive motors.

EXAMPLE

A hydraulically-operated, deep-well pump of 38-mm body diameter is designed to fit into a well bore of 50 mmϕ. The hydraulically-operated, deep-well pump will produce approximately 2200 liters per 24 hours from a depth of 1000 meters upon application of 600 mm strokes and 12 full cycles per minute. An annular piston area should be adjusted for different depths. For the hydraulically-operated, deep-well pump of 38 mmϕ, the approximate areas that will be exposed to fluid pressures are as follows:

projected, annular area (C)=0.7 $cm^2$;

top, annular, piston area (D)=4.4 $cm^2$;

middle, annular, piston area (E)=2.2 $cm^2$; and bottom, annular, piston area (F)=2.2 $cm^2$.

A hydraulic pressure of 200 kg/cm$^2$ is developed. With a hydraulic pressure of 200 kg/cm$^2$, the system has ample margin to overcome the friction of seals, and fluid in lines, with a 4 Kw power input.

It should be noted that, although the pumping depth effects the fluid friction of fluid conducting lines, the pumping depth has minimal bearing upon the power requirements.

Certain objects are set forth above and made apparent from the foregoing description and examples. However, since certain changes may be made in the above description and examples without departing from the scope of the invention, it is intended that all matters contained in the foregoing description and examples shall be interpreted as illustrative only of the principles of the invention and not in a limiting sense. With respect to the above description and examples then, it is to be realized that any descriptions and examples deemed readily apparent and obvious to one skilled in the art and all equivalent relationships to those stated in the examples and described in the specification are intended to be encompassed by the present invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention. It is also to be understood that the following claims are intended to cover all of the generic and specific features of the invention herein described, and all statements of the scope of the invention which, as a matter of language, might be said to fall therebetween.

What is claimed as invention is:

1. A pumping system, for extracting fluid from a formation located downhole in a borehole, having a single-acting, hydraulically-operated, reciprocating, deep-well, fluid-extraction pump, of a diameter small enough to be installed in bowed, horizontal and angular wells, and being connected to a number of other similar single-acting, hydraulically-operated, reciprocating, deep-well, fluid-extraction pumps, said pumping system comprising:

a. an elongate, tubular, outer sleeve extending downward from ground level;

b. a tubular sleeve enclosed by the elongate, tubular, outer sleeve;

c. a top, tubular, inner sleeve located above and attached to the tubular sleeve and extending to ground level;

d. a lower, central conduit extending along and encompassed by the tubular sleeve;

e. an upper, central conduit extending along and encompassed by the top, tubular, inner sleeve;

f. a production chamber located outside the tubular sleeve or the top, tubular inner sleeve and inside the elongate, tubular, outer sleeve;

g. a series of pressure chambers comprising:

(i) a top, pressure chamber positioned below and directly connected to the production chamber, (ii) a middle, pressure chamber positioned below and separated from the top, pressure chamber, and (iii) a bottom, pressure chamber positioned below and separated from the middle, pressure chamber;

h. a number of free passages serving as a sole direct path between and being only connected to the production chamber and the top, pressure chamber, and, alternately and under pressure, supplying fluid to the top, pressure chamber from the production chamber and exhausting fluid from the top, pressure chamber into the production chamber;

i. an injection piston;

j. a compound, stepped piston being coaxial with the elongate, tubular, outer sleeve and with the number of free passages and comprising:

(i) a telescopic, fluid line sliding through the lower, central conduit up from and down into the top, pressure chamber existing outside the telescopic, fluid line and inside the elongate, tubular, outer sleeve, having a projected, annular area on its top whereupon fluid in the lower, central conduit exerts downward pressure, serving as a sole connection to the middle, pressure chamber, and connecting the middle, pressure chamber to the lower, central conduit, (ii) a tubular, middle section, of a plurality of diameters and connected to the lower end of the telescopic, fluid line, comprising:

A. a top, annular, piston area neighboring the top, pressure chamber and undergoing exertion of downward pressure by any fluid collecting in the top, pressure chamber, B. a middle, annular, piston area neighboring the middle, pressure chamber and undergoing exertion of upward pressure by any fluid collecting in the middle, pressure chamber, C. a bottom, annular, piston area, having a smaller diameter than the top, annular, piston area, neighboring the bottom, pressure chamber, and undergoing exertion of upward pressure by any fluid collecting in the bottom, pressure chamber, with the top, annular, piston area located farthest from and the bottom, annular, piston area located closest to the formation, D. a slotted, guide bushing, serving as a leading agent of the compound, stepped piston along a portion of the elongate, tubular, outer sleeve, affecting size of the top; pressure chamber, and providing a sole passage for upward flow of any fluid from the bottom, pressure chamber to the top, pressure chamber, E. an intensifier piston being positioned in axial alignment with the compound, stepped piston and serving as a path for any fluid flowing between the top, pressure chamber and the bottom, pressure chamber, F. a production fluid-inlet, pump-valve means being positioned inside the intensifier piston and serving as a valve means for any fluid flowing into the bottom, pressure chamber, G. a production fluid-discharge, pump-valve means positioned inside the intensifier piston and serving as a valve means for any fluid discharged from the bottom, pressure chamber to the top, pressure chamber, H. radial holes in the compound, stepped piston, being positioned towards lower end of the intensifier piston, creating an inlet for any fluid flowing into and an outlet for any fluid flowing out of the bottom, pressure chamber through a radial clearance of the injection piston, and I. an adapter positioned below the bottom, pressure chamber, (iii) a suction tube passing through and being coaxial and concentric with the adapter, with the bottom, pressure chamber being located outside the suction tube and inside a portion of the elongate, tubular, outer sleeve, (iv) a dynamic, suction filter, having a flue-mesh screen, being connected at its bottom to the suction tube, being located below any top, hydraulic-well fluid and above any bottom, hydraulic-well fluid, and serving as a filtering pass for any hydraulic-well fluid extracted from the formation through the screen, with any top, hydraulic-well fluid contained in a space simultaneously located outside the suction tube, between the adapter and the dynamic, suction filter, and inside a portion of the elongate, tubular, outer sleeve having a minimum of one bleed hole for avoiding gas locks by purging out any gas that is collected therein, and (v) a narrow passage, being located inside the elongate, tubular, outer sleeve and outside the dynamic, suction filter, connecting any top, hydraulic-well fluid, to any bottom, hydraulic-well fluid, and serving as a passage for downward transmittal of any top, hydraulic-well fluid when the dynamic, suction filter is moved upward and as a passage for upward transmittal of any bottom, hydraulic-well fluid when the dynamic, suction filter is moved downward, thus preventing collection of sand and other particles on the dynamic, suction filter and setting up the limits of any top, hydraulic-well fluid and of any bottom, hydraulic-well fluid; and k. an above-ground installation of a motor-fluid generator and of a control valving system for collecting any extracted hydraulic-well fluid in a deposit.

2. The pumping system of claim 1 wherein the diameter of each single-acting, hydraulically-operated, reciprocating, deep-well, fluid-extraction pump is at least approximately 30 min.

3. A number of interconnected single-acting, hydraulically-operated, reciprocating, deep-well, fluid-extraction pumps for extracting fluid from a formation located downhole in a borehole, having a diameter small enough to be installed in bowed, horizontal and angular wells, where each pump comprises:

a. an elongate, tubular, outer sleeve extending downward from ground level and comprising in descending order a plurality of outer sleeves, connected to one another by a series of seal assemblies including but not limited to a top, seal assembly, as follow:

(i) a top, tubular, outer sleeve, (ii) an upper-middle, tubular, outer sleeve sealed, using the top, seal assembly, to the top, tubular, outer sleeve, (iii) a middle, tubular, outer sleeve, sealed to the upper-middle, tubular, outer sleeve, (iv) a lower-middle, tubular, outer-sleeve sealed to the middle, tubular, outer sleeve, and (v) a bottom,, tubular, outer sleeve sealed to the lower-middle, tubular, outer sleeve and having a minimum of one bleed hole at its upper end to avoid gas locks by purging out any gas that is collected therein;

b. a tubular sleeve enclosed by and being coaxial and concentric with the top, tubular, outer sleeve;

c. a top, tubular, inner sleeve extending to ground level in axial alignment and concentric with the top, tubular, outer sleeve and being engaged at its lower end with the tubular sleeve;

d. a lower central conduit extending along and encompassed by the tubular sleeve;

e. an upper, central conduit extending along and encompassed by the top, tubular, inner sleeve;

f. a production chamber located outside the tubular sleeve or the top, tubular, inner sleeve and inside the top, tubular, outer sleeve;

g. a series of pressure chambers comprising:

(i) a top, pressure chamber positioned below and directly connected to the production chamber, (ii) a middle, pressure chamber positioned below and separated from the top, pressure chamber, and (iii) a bottom, pressure chamber positioned below and separated from the middle, pressure chamber;

h. a number of free passages serving as a sole direct path between and being only connected to the production chamber and the top, pressure chamber, extending through the top seal assembly, and, alternately and under pressure, supplying fluid to the top, pressure chamber from the production chamber and exhausting fluid from the top, pressure chamber into the production chamber;

i. an injection piston; and j. a compound, stepped piston being coaxial with the number of free passages, being coaxial with and located inside the elongate, tubular, outer sleeve, and comprising:

(i) a telescopic, fluid line sliding through the lower, central conduit up from and down into the top, pressure chamber existing outside the telescopic, fluid line and inside the upper-middle, tubular, outer sleeve, having a projected, annular area on its top whereupon fluid in the lower, central conduit exerts downward pressure, serving as a sole connection to the middle, pressure chamber, being coaxial with the top, tubular, outer sleeve, and connecting the middle, pressure chamber to the lower, central conduit, (ii) a tubular, middle section, of a plurality of diameters and connected to lower end of the telescopic, fluid line, comprising:

A. a top, annular, piston area neighboring the top, pressure chamber and undergoing exertion of downward pressure by any fluid collecting in the top, pressure chamber, B. a middle, annular, piston area neighboring the middle, pressure chamber and undergoing exertion of upward pressure by any fluid collecting in the middle, pressure chamber, C. a bottom, annular, piston area, having a smaller diameter than the top, annular, piston area, neighboring the bottom, pressure chamber, and undergoing exertion of upward pressure by any fluid collecting in the bottom, pressure chamber, with the top, annular, piston area located farthest from and the bottom, annular, piston area located closest to the formation, D. a slotted, guide bushing, serving as a leading agent of the compound, stepped piston along the upper-middle, tubular, outer sleeve, affecting size of the top, pressure chamber, and providing a sole passage for flow of any fluid from the bottom, pressure chamber to the top, pressure chamber, E. an intensifier piston, being positioned in axial alignment with the compound, stepped piston and serving as a path for any fluid flowing between the top, pressure chamber and the bottom, pressure chamber, F. a production fluid-inlet, pump-valve means, comprising a suction, check valve, being positioned inside the intensifier piston, and serving as a valve means for any fluid flowing into the bottom, pressure chamber, G. a production fluid-discharge, pump-valve means, comprising a check valve, being positioned inside the intensifier piston, and serving as a valve means for any fluid discharged from the bottom, pressure chamber to the top, pressure chamber, H. radial holes in the compound, stepped piston, being positioned below the production fluid-discharge, pump-valve means and towards lower end of the intensifier piston, creating an inlet for any fluid flowing into and an outlet for any fluid flowing out of the bottom, pressure chamber and being connected to the bottom, pressure chamber by a radial clearance of the injection piston, and I. an adapter positioned on top of the bottom, tubular, outer sleeve, (iii) a suction tube passing through and being coaxial and concentric with the adapter, with the bottom, pressure chamber being located outside the suction tube and inside the lower-middle, tubular, outer sleeve, (iv) a dynamic, suction filter, having a fine-mesh screen, being connected at its bottom to the suction tube, being located below any top, hydraulic-well fluid and above any bottom, hydraulic-well fluid, and serving as a filtering pass for any hydraulic-well fluid extracted from the formation through the screen, with any top, hydraulic-well fluid contained in a space simultaneously located outside the suction tube, between the adapter and the dynamic, suction filter, and inside the bottom, tubular, outer sleeve, (v) a narrow passage, being located inside the bottom, tubular, outer sleeve and outside the dynamic, suction filter, connecting any top, hydraulic-well fluid, to any bottom, hydraulic-well fluid, and serving as a passage for downward transmittal of any top, hydraulic-well fluid when the dynamic, suction filter is moved upward and as a passage for upward transmittal of any bottom, hydraulic-well fluid when the dynamic, suction filter is moved downward, thus preventing collection of sand and other particles on the dynamic, suction filter and setting up the limits of any top, hydraulic-well fluid and of any bottom, hydraulic-well fluid, (vi) a threaded core plugging the lower end of the suction tube, and (vii) a safety screen fastened into the bottom, tubular, outer sleeve and used to screen any matter flowing therethrough and to serve as a barrier for any falling parts of the single-acting, hydraulically-operated, reciprocating, deep-well, fluid-extraction pump.

4. The number of single-acting, hydraulically-operated, reciprocating, deep-well, fluid-extraction pumps of claim 3 wherein the diameter of each single-acting, hydraulically-operated, reciprocating, deep-well, fluid-extraction pump is at least approximately 30 mm.

5. The number of single-acting, hydraulically-operated, reciprocating, deep-well, fluid-extraction pumps of claim 3 wherein the series of seal assemblies, in addition to the top, seal assembly, comprises:

a. an upper-middle, seal assembly sealing the middle, tubular, outer sleeve to the upper-middle, tubular, outer sleeve and comprising:

(i) a number of seal housings being concentric and coaxial with the upper-middle, tubular, outer sleeve, and (ii) a number of dynamic seals housed by the number of seal housings of the upper-middle, seal assembly;

b. a lower-middle, seal assembly sealing the lower-middle, tubular, outer sleeve to the middle, tubular, outer sleeve and comprising:

(i) number of seal housings being concentric and coaxial with the middle, tubular, outer sleeve, (ii) a number of dynamic seals located adjacent to and being coaxial and concentric with the intensifier piston and housed by the number of seal housings of the lower-middle, seal assembly, and (iii) a number of upper, dynamic, self-adjusting, fluid seals being concentric with and in axial alignment with the lower-middle, tubular, outer sleeve and serving as a seat for the number of dynamic seals and for the number of seal housings of the lower-middle, seal assembly; and c. a bottom seal assembly sealing the bottom, tubular, outer sleeve to the lower-middle, tubular, outer sleeve and comprising:

(i) a number of lower, dynamic, self-adjusting, fluid seals being concentric with and in axial alignment with the bottom, tubular, outer sleeve, (ii) a number of dynamic seals located adjacent to and being coaxial and concentric with the suction tube, and (iii) a bottom, seal housing being coaxial and concentric with the suction tube and housing the number of lower, dynamic, self-adjusting, fluid seals and the number of dynamic seals of the bottom seal assembly.

6. The number of single-acting, hydraulically-operated, reciprocating, deep-well, fluid-extraction pumps of claim 3 wherein the top seal assembly is concentric with the telescopic, fluid line and comprises:

a. a seal retainer b. a top, seal housing comprising:

(i) an inner cylindrical section, being concentric and coaxial with the tubular sleeve and with the telescopic, fluid line, and (ii) an outer cylindrical section, being connected to and encompassing the inner, cylindrical section, being concentric and coaxial with the tubular sleeve, and sealing and separating the top, tubular, outer sleeve and the upper-middle, tubular, outer sleeve, with any space located outside the inner, cylindrical section and inside the outer, cylindrical section defining the number of free passages; and c. a number of dynamic and static seals, retained by the seal retainer, embraced by the inner, cylindrical section of the top, seal housing and separated from the tubular sleeve and from the number of free passages, comprising:

(i) a number of dynamic seals positioned adjacent to the telescopic, fluid line, above the seal retainer and below the tubular sleeve, (ii) a number of static seals located apart from the number of dynamic seals, located apart from and in between the telescopic, fluid line and the number of free passages, and separated from the number of free passages by the inner, cylindrical section of the top, seal housing, and (iii) a dynamic seal separating any other dynamic seals and any static seals from one another.

7. The pumping system of claim 5 wherein the number of dynamic, self-adjusting, fluid seals comprises:

a. a plurality of closely-fitting, seal rings, with male members, having split openings, positioned at about 120° with respect to one another, and with a slight diameter interference fit with the intensifier piston;

b. a non-split, spacer ring being placed adjacent to any tubular, outer sleeve;

c. a spring ring being, along with the plurality of closely-fitting, seal rings, axially approximately 20 micrometers to approximately 100 micrometers shorter than the non-split, spacer ring, and being separated from the non-split, spacer ring by a radial clearance small enough to cause a substantial pressure drop in any axial, turbulent, fluid flow, with the plurality of closely-fitting, seal rings being mounted each over its own male member upon initial exertion of force on and for opening the split openings, upon inward radial biasing of the split openings by the spring ring and upon fazing of split lines at about 120° between split openings of the plurality of closely-fitting, seal rings; and d. a pair of pressure-drop rings housing, at a distance from one pressure-drop ring of each pair, a plurality of closely-fitting, seal rings, the spring ring, and the non-split, spacer ring, said distance from one pressure drop ring of each pair defining an axial clearance through which any fluid passing any pair of pressure-drop rings seeps resulting in flow of the fluid behind the spring ring and exertion of a radially inward pressure on the plurality of closely-fitting, seal rings, with said radially inward pressure, combined with reciprocating motion of the intensifier piston, wearing bore of the plurality of closely-fitting, seal rings in order to conform to the contour of the sliding intensifier piston until any split ends are butted, resulting in a clearance of under a few micrometers.

8. A pumping system, for extracting fluid from a formation located downhole in a borehole, having a single-acting, hydraulically-operated, reciprocating, deep-well, fluid-extraction pump of a diameter small enough to be installed in bowed, horizontal and angular wells, and being connected to a number of other similar single-acting, hydraulically-operated, reciprocating, deep-well, fluid-extraction pumps, said pumping system comprising:

a. a four-port, fluid-flow, directional, control valve connected to a number of ports comprising:

(i) a production-chamber, outlet port, (ii) a central-conduit, outlet port, (iii) a deposit port, with the central-conduit, outlet port being connected to the deposit port in parallel-flow porting and with the production-chamber, outlet port being connected to the deposit port in crossed-flow porting, and (iv) a pressure port, with the pressure port connected to the central-conduit, outlet port in crossed-flow porting and with the pressure port connected to the production-chamber, outlet port in parallel-flow porting;

b. a hydraulic pump for energizing the pressure port and, consecutively and alternately, exerting an excess hydrostatic pressure on the production-chamber, outlet port and on the central-conduit, outlet port in comparison to one another;

c. a pair of circuit operators comprising:

(i) a right-pilot, circuit operator for changing the hydraulic, fluid-flow pattern from parallel-flow porting to crossed-flow porting, and (ii) a left-pilot, circuit operator for changing the hydraulic, fluid-flow pattern from crossed-flow porting to parallel-flow porting;

d. an elongate, tubular, outer sleeve extending downward from ground level;

e. a tubular sleeve enclosed by the elongate, tubular, outer sleeve;

f. a top, tubular, inner sleeve located above and attached to the tubular sleeve and extending to ground level;

g. a lower, central conduit extending along and encompassed by the tubular sleeve;

h. an upper, central conduit extending along and encompassed by the top, tubular, inner sleeve used for leading any excess force exerted by the pressure port on the central-conduit, outlet port downwards to the lower, central conduit and any excess force from the lower, central conduit upwards to the central-conduit, outlet port;

i. a production chamber located outside the tubular sleeve or the top, tubular inner sleeve and inside the elongate, tubular, outer sleeve;

j. a series of pressure chambers comprising:

(i) a top, pressure chamber positioned below and directly connected to the production chamber, (ii) a middle, pressure chamber positioned below and separated from the top, pressure chamber, and (iii) a bottom, pressure chamber positioned below and separated from the middle, pressure chamber;

k. a number of free passages serving as a sole direct path between and being only connected to the production chamber and the top, pressure chamber and, alternately and under pressure, supplying fluid to the top, pressure chamber from the production chamber and exhausting fluid from the top, pressure chamber into the production chamber;

l. an injection piston;

m. a compound, stepped piston being coaxial with the elongate, tubular, outer sleeve and with the number of free passages and comprising:

(i) a telescopic, fluid line sliding through the lower, central conduit up from and down into the top, pressure chamber existing outside the telescopic, fluid line and inside the elongate, tubular, outer sleeve, having a projected, annular area on its top whereupon fluid in the lower, central conduit exerts downward pressure, and serving, during crossed-flow porting when the right-pilot, circuit operator is activated and an excess force is supplied to the central-conduit, outlet port, as entrance of fluid from the central-conduit, outlet port through the upper, central conduit and the lower, central conduit into the middle, pressure chamber, (ii) a tubular, middle section, of a plurality of diameters and connected to lower end of the telescopic, fluid line, comprising:

A. a top, annular, piston area neighboring the top, pressure chamber and undergoing exertion of downward pressure by any fluid collecting in the top, pressure chamber, B. a middle, annular, piston area neighboring the middle, pressure chamber and undergoing exertion of upward pressure by any fluid collecting in the middle, pressure chamber, said upward pressure resulting in upward movement of the compound, stepped piston and in an increase in previously-existing below atmospheric pressure of the production chamber due to upward flow of fluid from the top, pressure chamber through the number of free passages into the production chamber, connected to the production-chamber, outlet port during the existing crossed-flow porting, and leading to discharge of product from the production-chamber, outlet port into the deposit port, C. a bottom, annular, piston area, neighboring the bottom, pressure chamber and having a smaller diameter and undergoing exertion of an intensified pressure in comparison to the top, annular, piston area, resulting in reverse injection of the compressed fluid from the bottom, pressure chamber and in an evacuation of the bottom, pressure chamber, with the top, annular, piston area located farthest from and the bottom, annular, piston area located closest to the formation, D. a slotted, guide bushing, serving as a leading agent of the compound, stepped piston along a portion of the elongate, tubular, outer sleeve, affecting the size of the top, pressure chamber, and providing a sole passage for flow of any fluid from the bottom, pressure chamber to the top, pressure chamber, E. an intensifier piston positioned in axial alignment with the compound, stepped piston and serving as a path for any fluid flowing between the top, pressure chamber and the bottom, pressure chamber, F. a production fluid-inlet, pump-valve means being positioned inside the intensifier piston and serving as a valve means for any fluid flowing into the bottom, pressure chamber, G. a production fluid-discharge, pump-valve means positioned inside the intensifier piston and serving as a valve means for any fluid discharged from the bottom, pressure chamber to the top, pressure chamber, H. radial holes in the compound, stepped piston, being positioned toward the lower end of the intensifier piston, creating an inlet for any fluid flowing into and an outlet for fluid flowing out of the bottom, pressure chamber and being connected to the bottom, pressure chamber by a radial clearance of the injection piston, and I. an adapter positioned below the bottom, pressure chamber, (iii) a suction tube passing through and being coaxial and concentric with the adapter, with the bottom, pressure chamber being located outside the suction tube and inside a portion of the elongate, tubular, outer sleeve, (iv) a dynamic, suction filter, having a fine-mesh screen, being connected at its bottom to, and moving up and down with, the suction tube, being located below any top, hydraulic-well fluid and above any bottom, hydraulic-well fluid, and serving as a filtering pass for any hydraulic-well fluid extracted from the formation through the screen into the bottom, pressure chamber, with any top, hydraulic-well fluid contained in a space simultaneously located outside the suction tube, between the adapter and the dynamic, suction filter, and inside a portion of the elongate, tubular, outer sleeve having a minimum of one bleed hole for avoiding gas locks by purging out any gas that is collected therein, and (v) a narrow passage, being located inside the elongate, tubular, outer sleeve and outside the dynamic, suction filter, connecting any top, hydraulic-well fluid, to any bottom, hydraulic-well fluid, and serving as a passage for downward transmittal of any top, hydraulic-well fluid when the dynamic, suction filter is moved upward and as a passage for upward transmittal of any bottom, hydraulic-well fluid when the dynamic, suction filter is moved downward, thus preventing collection of sand and other particles on the dynamic, suction filter and setting up the limits of any top, hydraulic-well fluid and of any bottom, hydraulic-well fluid; and n. a pilot valve subassembly for activating the left-pilot, circuit operator, changing the hydraulic, fluid flow pattern to parallel flow porting, switching an excess force to the production-chamber, outlet port, in comparison to the central-conduit, outlet port, through the four-port, fluid-flow, directional, control valve, resulting in reversed pressurized fluid flow downward through the number of free passages from the production chamber into the top, pressure chamber, in application of an amount of downward pressure on the top, annular, piston area, in transfer of a larger amount of downward force through the bottom, annular, piston area, being smaller than the top, annular, piston area, on any fluid in the bottom, pressure chamber, and in upward flow of fluid from the bottom, pressure chamber through the radial holes, through the production, fluid-discharge, pump-valve means into the top, pressure chamber, and consequently in formation of a suction cavity in the bottom, pressure chamber encouraging flow of any bottom, hydraulic-well fluid through the dynamic, suction filter into the bottom, pressure chamber, and simultaneously resulting, with the exertion of downward pressure on the top, annular, piston area, in exertion of pressure upon the middle, pressure chamber, in upward flow of fluid through the telescopic, fluid line and in injection of fluid from the central-conduit, outlet port through the deposit port into a deposit.

9. The pumping system of claim 8 wherein a ratio of pressure intensification, defined as the ratio of the top, annular, piston area to the bottom, annular, piston area, is any number greater than one, as long as friction of the number of dynamic fluid seals, fluid friction of pipes, and cracking pressure of the production fluid-discharge, pump-valve means are overcome.

10. The pumping system of claim 8 wherein the pilot valve subassembly, serving as a hydraulic-power, control circuit, being fluid pilot operated and detent retained at two extreme positions and being connected to a number of drive motors of nearby wells to, optionally, supply pressurized, hydraulic fluid to each drive motor, comprises:

a. a switching circuit, being based on a self-cycling pressure generation circuit and a self-cycling switching circuit and on an individually adjustable time allowed for a pumping cycle and for a suction cycle, and comprising:

(i) a left, flow-control valve located left of the four-port, fluid-flow, directional, control valve and left of the left-pilot, circuit operator and used for measuring cyclic reciprocation frequency and hydraulic pressure of left of the four-port, fluid-flow, directional, control valve, (ii) a right, flow-control valve located right of the four-port, fluid-flow, directional, control valve and right of the right-pilot, circuit operator and used for measuring cyclic reciprocation frequency and hydraulic pressure of right of the four-port, fluid-flow, directional, control valve, (iii) a left, hydro-pneumatic accumulator, located left of the four-port, fluid-flow, directional, control valve and left of the left-pilot, circuit operator and containing a compressible gas used to provide any elasticity required for operation of the switching circuit by shifting the left-pilot, circuit operator, located left of the four-port, fluid-flow, directional, control valve, away from the left, hydro-pneumatic accumulator and in the right direction when pressure of the compressible gas of the left, hydro-pneumatic accumulator upon any pilot fluid exceeds holding force of the opposing detent, (iv) a right, hydro-pneumatic accumulator located right of the four-port, fluid-flow, directional, control valve and right of the right-pilot, circuit operator and containing a compressible gas used to provide any elasticity required for operation of the switching circuit by shifting the right-pilot, circuit operator, located right of the four-port, fluid-flow, directional, control valve, away from the right, hydro-pneumatic accumulator and in the left direction when pressure of the compressible gas of the right hydro-pneumatic accumulator upon any pilot fluid exceeds holding force of the opposing detent, (v) a left, check valve connected to the left-pilot, circuit operator, located left of the four-port, fluid-flow, directional, control valve and used for exhausting any previously pressurized fluid after the left, hydro-pneumatic accumulator has shifted in the right direction, and (vi) a right, check valve connected to the right-pilot, circuit operator, located right of the four-port, fluid-flow, directional, control valve and used for exhausting any previously pressurized fluid after the right, hydro-pneumatic accumulator has shifted in the left direction;

b. a deposit, connected to the deposit port, for collecting pumped, well fluid from the central-conduit, outlet port during parallel-flow porting and from the production-chamber, outlet port during crossed-flow porting consecutively and alternately;

c. an adjustable, flow limiter for limiting production flow of well fluid from the deposit port to the deposit;

d. a flow-sensor switch, serving as controller of any reciprocating pumping action, with an electrical contact, detecting any slight backpressure resulting from production overflow or establishing an electrical circuit, for stopping the hydraulic pump and for leading to a well-recovery cycle at cessation of any production fluid flow;

e. a timer, connected to the flow-sensor switch, undergoing readjustments upon establishment of the electrical circuit from the flow-sensor switch and serving to provide a predetermined, adjustable, time cycle for well recovery and to change the hydraulic, fluid flow pattern from parallel-flow porting to crossed-flow porting and from crossed-flow porting to parallel-flow porting consecutively and alternately;

f. a drive motor, of the hydraulic pump, connected to the timer;

g. a suction filter for protecting inlet of the hydraulic pump from damage by large particles;

h. an adjustable, overpressure, relief valve for protecting the hydraulic pump from overpressure and pressure peaks;

i. a pressure gauge for indicating the maximum pressure setting of the overpressure, relief valve;

j. a check valve being connected to the production-chamber, outlet port and opening up during intensified pressures to provide an optional path for a portion of the fluid flowing to the production-chamber, outlet port; and k. a relief valve being connected to and following the check valve, with any fluid from the check valve passing through the relief valve and, then, through the flow-restriction valve and the flow-sensor switch.

* * * * *